US007111398B1

(12) United States Patent
Park

(10) Patent No.: US 7,111,398 B1
(45) Date of Patent: Sep. 26, 2006

(54) HAIR TRIMMING DEVICE

(75) Inventor: Steven S. Park, 4334 W. Lawrence Ave., Chicago, IL (US) 60630

(73) Assignee: Steven S. Park, Chicago, IL (US)

( * ) Notice: Subject to any disclaimer, the term of this patent is extended or adjusted under 35 U.S.C. 154(b) by 0 days.

(21) Appl. No.: 11/197,011

(22) Filed: Aug. 3, 2005

(51) Int. Cl.
*B26B 21/12* (2006.01)

(52) U.S. Cl. ..... 30/30; 30/51; 30/55; 30/78

(58) Field of Classification Search ..... 30/51, 30/54, 55, 77, 78, 79, 346.57, 53, 47, 30, 30/64

See application file for complete search history.

(56) References Cited

U.S. PATENT DOCUMENTS

| | | | | |
|---|---|---|---|---|
| 1,028,461 | A * | 6/1912 | Hetlyn | 30/53 |
| 1,079,095 | A * | 11/1913 | Beard | 30/78 |
| 1,234,834 | A * | 7/1917 | Warren | 30/47 |
| 1,908,016 | A * | 5/1933 | Harmon | 30/65 |
| 2,237,676 | A * | 4/1941 | Lewis | 30/30 |
| 3,574,936 | A | 4/1971 | Bullerman | |
| 4,928,716 | A | 5/1990 | Greene | |
| 4,980,973 | A | 1/1991 | Lee et al. | |
| 5,568,688 | A | 10/1996 | Andrews | |
| 5,655,301 | A | 8/1997 | Dickson | |
| 5,983,499 | A | 11/1999 | Andrews | |
| 6,505,403 | B1 | 1/2003 | Andrews | |
| D487,168 | S | 2/2004 | Hoekstra et al. | |

* cited by examiner

*Primary Examiner*—Hwei-Siu Payer
(74) *Attorney, Agent, or Firm*—Brinks Hofer Gilson & Lione

(57) ABSTRACT

A hair trimming device includes a cutter and a handle member. The cutter is substantially rectangular and flat and includes a blade and a frame. The handle member includes a hollow interior containing the cutter while the cutter is not in use. The cutter in use is exposed out of the handle member and is mounted above the handle member to be in line with the handle member. The frame member is configured to form a first contact line with a skin and at least one edge of the blade is configured to form a second contact line with hair. The second contact line is more distal from the skin than the first contact line.

15 Claims, 4 Drawing Sheets

HAIR TRIMMING DEVICE

BACKGROUND

1. Technical Field

The invention relates to hair trimming devices and more particularly, nose and ear hair trimming devices.

2. Background

Some hair trimming devices are used to shave or trim unwanted hair in nostrils or ears. The hair trimming may be performed regularly as the hair naturally grows. The hair trimming device may be handled by professionals such as a barber, a hair designer, etc., but it is frequently handled by the general public at home.

The hair trimming device includes a blade that trims the hair. The blade of conventional hair trimming devices has shapes such circular shape, curved shape, ball shape, etc. The blade is intentionally designed to be more suitable for nostrils or ears. While users are operating the blade in a narrow space of nostrils or ears, however, they may feel bulkiness and/or stuffiness due to the volume of the blade. Further, when users operate the blade to trim the hair in nostrils or ears, the bulky shape of the blade may cause cuts on soft skin of nostrils or ears, which may lead to infections and other complications.

The hair trimming device trims hair within nostrils and/or ears where dust and germs are filtered. For sanitary purpose, the hair trimming device may be replaced regularly. The hair trimming device may also be thoroughly cleaned after each use.

As noted above, the hair trimming device includes the blade that trims the hair. When the hair trimming device is used at home such as a bathroom, children may have access to the hair trimming device. The production of the hair trimming devices may focus on the low pricing and may not provide suitable protection measure. The blade of the conventional hair trimming device is often exposed for easy use and low production expenses.

BRIEF SUMMARY

By way of introduction only, a hair trimming device includes a cutter and a handle member. The cutter is substantially rectangular and flat. The cutter includes a blade and a frame member. The handle member has an elongated housing and includes a hollow interior containing the cutter while the cutter is not in use. The cutter in use is exposed out of the handle member and is mounted above the handle member. The frame member is configured to form a first contact line with a skin and at least one edge of the blade is configured to form a second contact line with a hair. The second contact line is more distal from the skin than the first contact line.

A method for manufacturing a hair trimmer is provided. In the method, a cutter is connected to an elongated handle member with a neck member, and the handle member is supplied with a mechanism that controls positioning of the cutter such that the cutter is housed in an interior of the handle member while the cutter is not in use. The neck member is attached to the cutter and the other end of the neck member is secured to the handle member.

DETAILED DESCRIPTION OF THE DRAWINGS AND THE PRESENTLY PREFERRED EMBODIMENTS

A hair trimming device includes a cutter having a frame member and a blade. The cutter is used to trim or cut hair in nostrils or ears. The blade may have a sharp edge on one side or both sides. The frame member covers the blade.

The cutter may be attached to a handle member. Users grip the handle member when they use the hair trimming device. The handle member may enclose the cutter while not in use. The hair trimming device may provide an improved safety.

The cutter is flat and thin. Users may manually operate the handle member and the cutter and trim the hair. No rotation movement or power means such as battery may be needed. After use, users may separate the cutter from the handle member and perform the thorough cleaning. Further, users may replace the cutter and reuse the handle member to save additional expenses.

Figure 1:
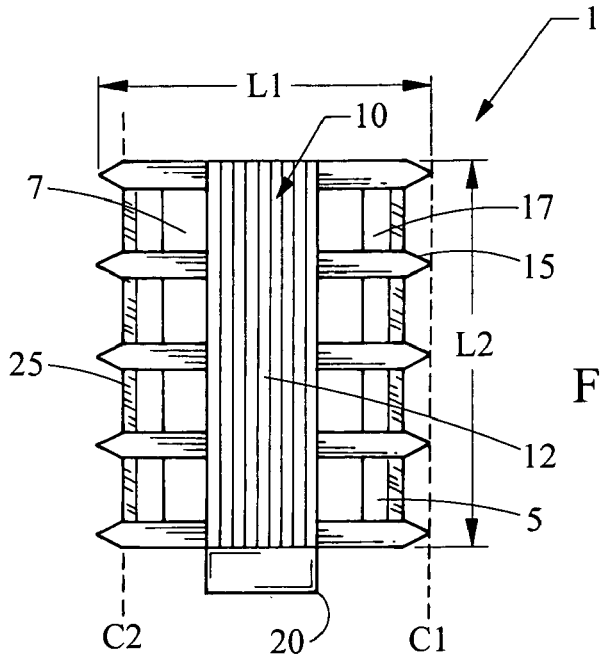
FIG. 1 is a front view of a cutter for use with a hair trimming device.

FIG. 1 shows a front view of a cutter 1 having a frame member 10. The frame member 10 covers a front surface of the cutter 1. The cutter 1 has blades 5 for trimming or cutting hairs at both edges 25. The cutter 1 has a body member 7 to which the blades 5 are attached. In other embodiment, the cutter 1 may have a blade at one edge. By way of example only, the cutter 1 may have a width L1 of about 5 mm and a length L2 of about 1 cm. This dimension may be suitable to encompass the narrow space of the nostrils. The cutter 1 may be made from metal such as steel. At the bottom, the cutter 1 has an extended portion. The extended portion is a part of a neck member 20 of the cutter 1. The neck member 20 longitudinally and demountably secures the cutter 1 to a handle member, which will be described in detail below in conjunction with FIG. 2.

The frame member 10 includes a center platform 12 and a plurality of ribs 15. In other embodiment, the center platform 12 may be omitted. The plurality of ribs 15 extends from the center platform 12 across the cutter 1. Two neighboring ribs are longitudinally spaced apart from each other. The blades 5 of the cutter 1 are exposed via a groove 17 formed between two neighboring ribs 15. The ribs 15 are extended beyond the edges of the blade 5 and form a first contact line C1 as shown in FIG. 1. The blade 5 forms a second contact line C2.

When the cutter 1 is inserted into nostrils or ears for hair trimming operation, the first contact line C1 contacts skin. The second contact line C2 does not contact skin because it is retracted inwardly from the first contact line C1. The second contact line C2 is more distal from the skin than the first contact line C1. Skin may be protected from being cut or injured with the blade 5 of the cutter 1. The second contact line C2 easily contacts the hair that reaches the blade 5 of the cutter 1. The hair reaches the blade 5 through the groove 17 and is trimmed or cut.

The cutter 1 is flat and thin. In use, the cutter 1 may not generate uncomfortable feeling upon insertion into the narrow space such as nostrils or ears. Because the cutter 1 is very thin, it may operate smoothly in the narrow space. No sophisticated and costly process may be needed to design shapes of the cutter 1 into a curved shape, a circular shape, etc. The production expenses may be reduced.

Figure 2:
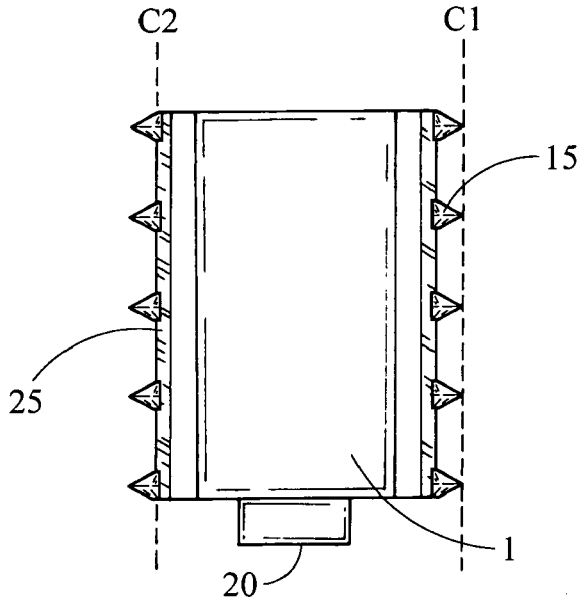
FIG. 2 is a rear view of the cutter.
Figure 3:
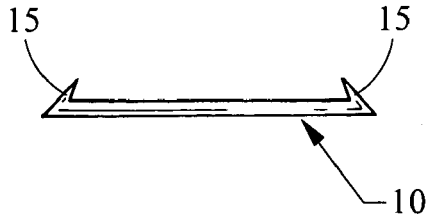
FIG. 3 is a side view of a frame member of the cutter.

FIG. 2 illustrates a rear surface of the cutter 1. The plurality of ribs 15 may stop at the edge of the blade 5 as the rear side is open. FIG. 3 illustrates a side view of the frame member 10. The cutter 1 with the frame member 10 on the front surface only may be flatter, slimmer and thinner than a cutter having the frame member on both sides. The production cost also may be reduced. The plurality of ribs 15 covers the edges of the cutter 1 as shown in FIG. 3, so that the blade 5 does not contact the skin.

As noted above, the rear surface of the cutter 1 is open and easily accessible by users. The edge 25 of the blade 5 actually contacts, cuts and/or trims the hair. The hair frequently remains in the cutter 1. Thus, the cutter 1 may be cleaned for sanitary purpose. After use, users may separate the blade 5 from the frame member 10. The rear side of the blade 5 is open and users may have easy access to the blade 5. Users may take the blade 5 out with fingers in the open rear surface. Alternatively, or additionally, users may slide the blade 5 down longitudinally and separate the blade 5 from the frame member 10. After separation, users are able to clean the blade 5 and the frame member 10 separately. Enhanced and thorough cleaning is possible. When the blade 5 needs replacement, the frame member 10 may be combined again with a new blade. The frame member 10 may be used repeatedly, which may reduce expenses to users.

Figure 4:
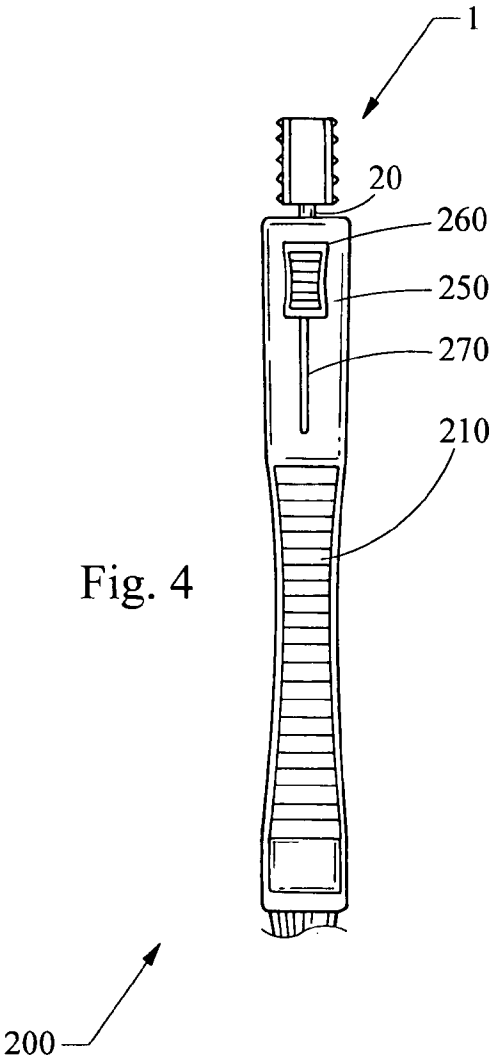
FIG. 4 illustrates one embodiment of a hair trimming device.

FIG. 4 illustrates one embodiment of a hair trimming device 200. The hair trimming device 200 includes the cutter 1 of FIG. 1. Cutters having various other structures and designs are available for use with the hair trimming device 200. The hair trimming device 200 also may include a handle member 210. The handle member 210 may include an elongated housing and has a rectangular shape. The handle member 210 may be made from plastic material. Various other shapes and material are available for the handle member 210 as long as there is a hollow interior and a comfortable grip is provided to users. Only by way of example, the handle member 210 may be about 5 cm long.

The handle member 210 may include a sliding mechanism 250 on a surface thereof. The sliding mechanism 250 includes a tab or button 260 and an elongated channel 270 where the tab 260 slides up and down. The tab 260 may be coupled to the neck member 20 that extends through the handle member 210. When the tab 260 slides down, the cutter 1 also slides down and is inserted into the interior of the handle member 210. When the tab 260 slides up, the cutter 1 also slides up and is exposed out of the handle member 210.

When the cutter 1 is in use, the sliding mechanism 250 may slide up the position of the cutter 1 above a top surface of the handle member 210. While the cutter 1 is not in use, the tab 260 slides down and the cutter 1 is completely enclosed in the handle member 210. This sliding mechanism 250 provides an improved safety protection for accidental cuts to users and/or children while the cutter 1 is not in use. Further, the hair trimming device 200 may not be damaged by other objects, external pressure, etc. because the cutter 1 is protected in the handle member 210.

The neck member 20 may connect the cutter 1 with the handle member 210. The neck member 20 longitudinally extends through the hollow interior of the handle member 210 and secures the cutter 1 in the handle member 210.

Figure 5:
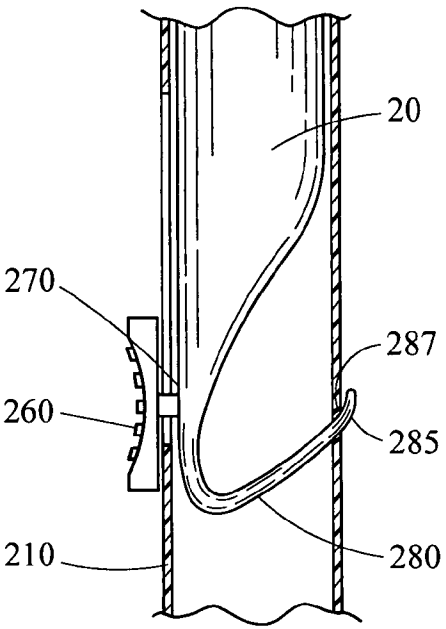
FIG. 5 illustrates a securing structure of the hair trimming device of FIG. 4.

FIG. 5 illustrates a securing structure of the hair trimming device 200. The end of the neck member 20 may have an anchor 280 that secures the neck member in a space formed with four inner walls of the handle member 210. The anchor 280 may be made from flexible material such as metal, plastic, etc. The flexible anchor snaps into the interior space of the handle member 210 to secure the neck member 20 and the cutter 1. The flexible anchor 280 allows the neck member 20 to move longitudinally. The anchor may have a hook shape, so that it moves longitudinally along with the neck member 20 while preventing the neck member 20 from arbitrary movement. The hook shape anchor 280 may be pressed against the inner walls of the handle member 210. The end 285 of the hook shape anchor 280 slightly extends through an aperture 287 of the handle member 210. The end of the anchor 280 secures the neck member 20 against the sliding movement by maintaining the position of the anchor 280 at the handle member 210. Upon the sliding movement, the neck member 20 may not move out of the handle member 210. Thus, the hook-shaped anchor 280 secures the neck member 20 and also allows it to move.

The hair trimming device 200 may operate as follows. Users may slide up the tab 260 along the channel 270, so that the cutter 1 is exposed outside of the handle member 210. Users slide the tab 260 up to the extent that the cutter 1 is longitudinally in line with the handle member 210. Users insert the cutter 1 into nostrils or ears. For example, when users trim nose hair, users insert the cutter 1 into nostrils. Users manually move the handle member 210 up and down slowly. The handle member 210 is operated manually and mechanically. No battery or other power means is needed, but may be used. The flat cutter 1 substantially encompasses the narrow space of nostrils and easily trims the extended and unwanted hair.

Figure 6:
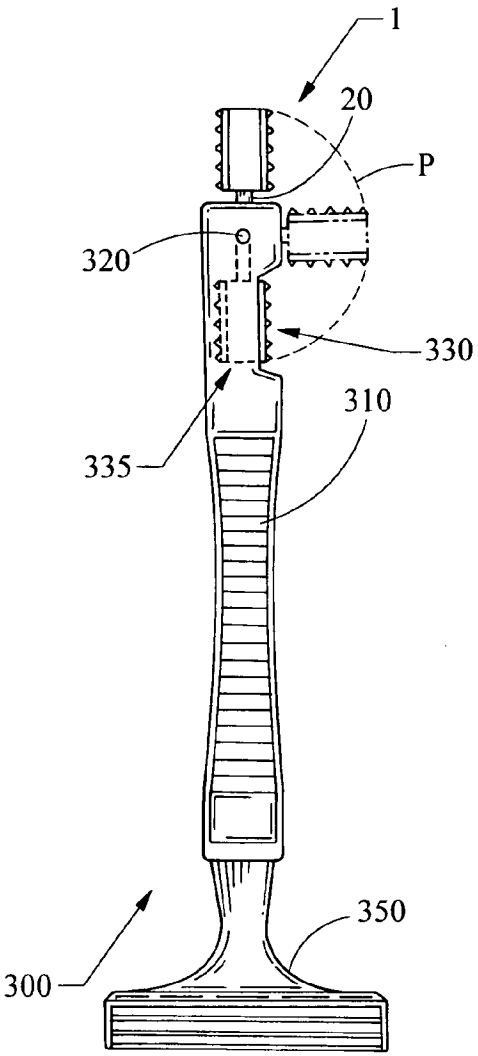
FIG. 6 illustrates the other embodiment of a hair trimming device.

FIG. 6 illustrates another embodiment of a hair trimming device 300. The hair trimming device 300 includes the cutter 1 and a handle member 310. The handle member 310 includes a bending mechanism that has a screw member 320 and a slit 330. The cutter 1 is connected to the handle member 310 with the neck member 20. The end of the neck member 20 is secured to the handle member 310 with the screw member 320. The screw member 320 may be used to secure the end of the neck member 20 and the handle member 310. The screw member allows the neck member 20 to rotate along a circular path. Various other securing means are possible. As the neck member rotates along the circular path, the cutter 1 changes its position along a circular path P. The circular path P has a greater radius than that of the circular path of the neck member 20.

As described above, the screw member 320 secures the cutter 1 and simultaneously, allows it to change its position. Users simply bend the cutter 1 down along the circular path P and push the cutter 1 into the slit 330. While not in use, the cutter 1 may be pushed into the slit 330 and hidden in the handle member 310.

Figure 7:
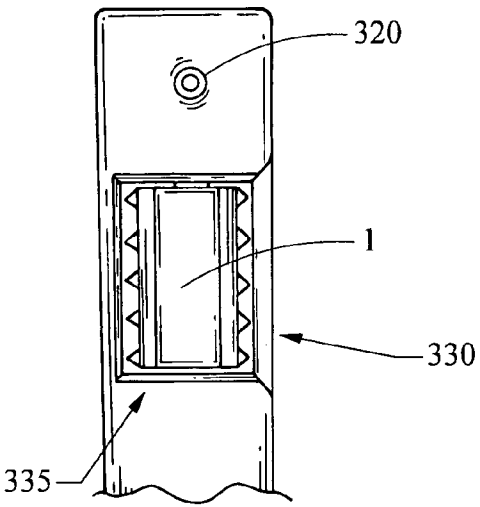
FIG. 7 illustrates a cutter retainer.

In other embodiment, a window or retainer 335 is formed on the front surface of the handle member 310 as shown in FIG. 7. When the cutter 1 is bent down into the interior of the handle member 310, users may have access to the cutter 1 via the window 335. When users desire to use the hair trimming device 300, they may move the cutter 1 up with ease via the window 335.

At the end of the handle member 310, a regular shaving razor 350 may be attached as illustrated in FIG. 6. The shaving razor 350 may be removable from the handle member 310. Users may tend to use the shaving razor 350 along with the hair trimming device 300. The shaving razor 350 is also usable with the hair trimming device 200 of FIG. 4.

Operation of the hair trimming device 300 is described. While the cutter 1 is not in use, it may be housed in the handle member 310. As described above, the cutter 1 is pushed into the slit 330. A hook or similar structure may be attached to one side of the cutter 1. The hook or similar structure may be extended outside the handle member 310. To use the cutter 1, users may pull the hook and take the cutter 1 out of the handle member 310. Alternatively, or additionally, the handle member 310 may include the window 335 on the front surface of the handle member 310, as shown in FIG. 7. When the cutter 1 is inserted into the handle member 310 via the slit 330, users have access to the cutter 1 via the window 335.

Users may move the cutter 1 upwardly along the circular path P. When the cutter 1 is in line with handle member 310, users insert the cutter 1 into nostrils or ears and move it up and down. After completing the hair trimming with the hair trimming device 300, users may engage in shaving with the shaving razor 350 attached to the handle member 310.

Figure 8:
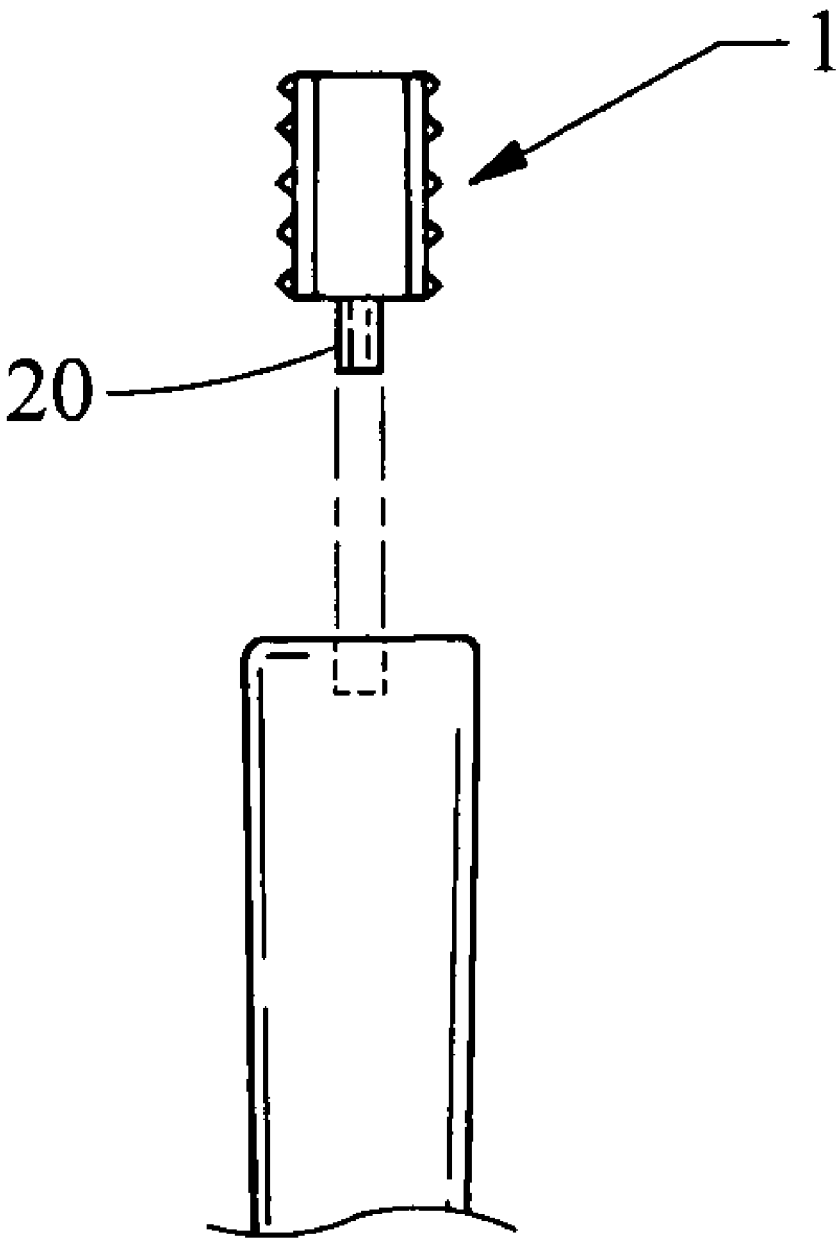
FIG. 8 illustrates a cutter removably separated from a handle member.

FIG. 8 illustrates the cutter 1 separated from a handle member including the handle member 210 or 310. After use, users may remove the cutter 1 and/or the shaving razor 350 from the handle member 210 or 310 for cleaning or replacement.

The hair trimming device described above may have advantages that it provides a compact and light structure. The cutter 1 is flat and thin. The cutter 1 is suitable for use in the narrow space such as nostrils or ears. Users simply move up and down the cutter 1 in nostrils or ears. With the hair trimming device having the compact structure, users may trim the hair with ease and comfort. Due to the compact structure, users may not experience any uncomfortable bulkiness and/or pressure.

The structure of the cutter 1 may reduce the production cost because the frame member 10 only covers the front surface of the cutter 1. The rear surface is open, so material cost may be reduced. Upon replacement, only the cutter 1 is replaced and other parts may be used again. The handle member 210 and 310 of the hair trimming device manually operate and does not require any battery. Users may save additional expenses for the battery.

The hair trimming device includes the sliding mechanism or bending mechanism which allows the cutter 1 to be housed in the handle member 210 and 310 while the cutter 1 is not in use. The sliding mechanism longitudinally moves the cutter 1 between an exposed position outside of the handle member 210 and 310 and a hidden position in the handle member. The bending mechanism changes the position of the cutter 1 along the circular path such that the cutter 1 is inserted into the interior of the handle member 210 and 310. Users move the cutter 1 to be inserted into the handle member 210 and 310 and operate the cutter 1 out of the handle member 210 and 310 with ease. The cutter 1 may not be damaged while not in use, in particular, when users travel with the hair trimming device. The hair trimming device may provide an improved safety and mobility, thereby minimizing unexpected cuts and injury and damages to the cutter 1.

It is therefore intended that the foregoing detailed description be regarded as illustrative rather than limiting, and that it be understood that it is the following claims, including all equivalents, that are intended to define the spirit and scope of this invention.

The invention claimed is:

1. A cutter for use with a hair trimming device, comprising:

a blade comprising a front surface, a rear surface arranged to be parallel to the front surface, and at least two cutting edges;

a frame member configured to removably cover at least a portion of the front surface and at least a portion of the two cutting edges, the frame member forming a first contact line with a skin;

wherein the two cutting edges of the blade are configured to form a second contact line with a hair and the second contact line is more distal from the skin than the first contact line;

a neck member for attaching the cutter to a handle of the hair trimming device to at least partially expose the two cutting edges when in use; and wherein the blade and the frame member are substantially rectangular and flat.

2. The cutter of claim 1, wherein the front surface is covered with the frame member and the rear surface is accessible from an outside when in use with the hair trimming device.

3. The cutter of claim 1, further comprising a center platform, the blade configured to be attached to at least one side of the center platform.

4. The cutter of claim 3, wherein the frame member comprises a plurality of ribs extending from the center platform outwardly.

5. The cutter of claim 4, wherein the plurality of ribs are longitudinally spaced apart from one another.

6. The cutter of claim 1, wherein the frame member comprises a plurality of ribs extending outwardly, wherein the plurality of ribs are longitudinally spaced apart from one another.

7. The cutter of claim 6, wherein an end of the plurality of ribs forms the first contact line.

8. The cutter of claim 6, wherein the frame member comprises a groove formed by two neighboring ribs and the edge of the blade is exposed via the groove to form the second contact line.

9. The cutter of claim 1, wherein the frame member comprises a plurality of ribs extending outwardly beyond the at least two cutting edges.

10. The cutter of claim 9, wherein the plurality of ribs are longitudinally spaced apart from one another.

11. The cutter of claim 1, wherein the blade is disposable.

12. The cutter of claim 1, wherein the frame member is disposable.

13. The cutter of claim 1, wherein the blade is removable.

14. The cutter of claim 1, wherein the frame member is removable.

15. The cutter of claim 1 wherein the cutter is disposable.

* * * * *